US008431213B2

(12) United States Patent
Levit

(10) Patent No.: US 8,431,213 B2
(45) Date of Patent: Apr. 30, 2013

(54) SHEET STRUCTURES HAVING IMPROVED COMPRESSION PERFORMANCE

(75) Inventor: Mikhail R. Levit, Glen Allen, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 447 days.

(21) Appl. No.: 12/615,447

(22) Filed: Nov. 10, 2009

(65) Prior Publication Data

US 2010/0124648 A1 May 20, 2010

Related U.S. Application Data

(60) Provisional application No. 61/114,710, filed on Nov. 14, 2008.

(51) Int. Cl.
*B32B 27/02* (2006.01)
*B32B 5/02* (2006.01)
*D21H 13/26* (2006.01)

(52) U.S. Cl.
USPC ..... 428/220; 428/311.51

(58) Field of Classification Search ..... None
See application file for complete search history.

(56) References Cited

U.S. PATENT DOCUMENTS

| | | | |
|---|---|---|---|
| 2,999,788 | A | 9/1961 | Morgan |
| 3,756,908 | A | 9/1973 | Gross |
| 4,334,468 | A | 6/1982 | Guttinger et al. |
| 4,336,096 | A | 6/1982 | Dedekind |
| 4,481,060 | A | 11/1984 | Hayes |
| 4,515,656 | A | 5/1985 | Memeger, Jr. |
| 4,752,355 | A | 6/1988 | Provost |
| 5,076,887 | A | 12/1991 | Hendren |
| 5,089,088 | A | 2/1992 | Hendren et al. |
| 5,098,514 | A | 3/1992 | Held |
| 5,141,583 | A | 8/1992 | Held |
| 5,149,394 | A | 9/1992 | Held |
| 5,320,892 | A | 6/1994 | Hendren et al. |
| 6,319,605 | B1 | 11/2001 | Murayama et al. |
| 6,838,401 | B1 | 1/2005 | Murayama et al. |
| 2007/0137818 | A1* | 6/2007 | Levit et al. ..... 162/146 |

FOREIGN PATENT DOCUMENTS

| | | |
|---|---|---|
| DE | 28 15 451 | 3/1979 |
| EP | 0 156 587 | 12/1990 |
| JP 54-50613-2004-167727 | | 6/2004 |

OTHER PUBLICATIONS

Pocius, A.V. "Adhesion". Kirk-Othmer Encyclopedia of Chemical Technology, (2002). pp. 501-524.*

* cited by examiner

*Primary Examiner* — Maria Veronica Ewald
*Assistant Examiner* — Prashant J Khatri

(57) ABSTRACT

This invention relates to a pressboard comprising a plurality of plies having thermostable floc and at least 40 weight percent aramid fibrids, the pressboard having a final average thickness of 0.9 mm or greater, the pressboard further having an a void content of 25 volume percent or less and a ply adhesion (Y) in megapascals defined by the equation $$Y>2.97(X)^{(-0.25)}$$

wherein (X) is the thickness of the pressboard in millimeters; the pressboard can have a compressibility of 1.6 percent or less and compression set of 0.18 percent or less.

6 Claims, No Drawings

SHEET STRUCTURES HAVING IMPROVED COMPRESSION PERFORMANCE

BACKGROUND OF THE INVENTION

1. Field of the Invention

This invention relates to sheet structures having improved localized ply-delamination performance and compression performance and processes for making same. These sheet structures include papers and pressboards that can be suitable for electrical insulation, composite structures, and other applications.

2. Description of Related Art

Thick sheet structures containing aramid fibrids are usually formed by making a ply of material using wet-lay technology followed by hot compression or densification of multiple plies of the material. Such multiple-ply sheet structures, having a final average or nominal thickness of up to about 0.9-1.0 mm, are typically referred to as paper; if the final average or nominal thickness is 0.9-1.0 mm or greater, the sheet structure is typically called pressboard.

If the adhesion between the ply layers (i.e. the ply adhesion) is not both adequately high and uniform in the final sheet structure, additional processing steps conducted on the sheet structure such as slitting into narrow strips and/or punching of small parts can cause delamination of the sheet structure and the loss of the part. In particular, the use of high-speed punching operations combined with the desire for smaller punched parts requires improved localized ply adhesion. These punching operations also require a sheet structure that is flat and not warped; otherwise it is impossible to make final parts of the precise size and necessary shape.

Exemplary processes for thermally laminating ply layers to make aramid pressboard are disclosed in U.S. Pat. No. 4,752,355 to Provost, and U.S. Pat. Nos. 5,076,887 and 5,089,088 to Hendren. All of these processes require the removal of moisture from the plies prior to the thermal lamination at a temperature of from 270 to 320 degrees C. U.S. Pat. No. 4,481,060 to Hayes for the making of thick papers is illustrative of the need to fully dry the plies prior to lamination, the conventional thinking being that any excessive moisture contained in the plies would flash once the heated sheet structure exited the high compression zone, causing areas in the sheet to delaminate, and creating what are known in the art as "blisters", making the paper or pressboard unusable. This effect is illustrated by U.S. Pat. No. 4,515,656 to Memeger wherein a coherent, expanded, highly-voided sheet, normally unacceptable for pressboard, is made by increasing the water content in the sheet to at least 60% by weight, heating the wet sheet under pressure and temperature to vaporize the water rapidly and simultaneously expand the sheet. This process forms random expanded macroscopic cells within and between the plies.

However, Unexamined Japanese Patent Publication Showa 54-50613 discloses a method for producing an aromatic polyamide paper laminated material wherein water, or a mixture of water and an organic solvent soluble to water, is added to aromatic polyamide paper to increase the moisture content of the paper up to 6 to 30% by the weight. Several of these wetted papers are then layered together and the assembled layers are then first compressed at normal (room) temperature, follow by heating of the layers to a low temperature while the compression of the assembled layers is maintained. The low temperature is below what is called in the publication the "melting temperature of the aromatic polyamide" and is in the range of 150 to 230 C, preferably the range of 170 to 190 C. This low temperature thermal pressing is followed by cooling to 100 C or lower while maintaining the pressure on the laminated material. The first two steps, involving a first compression step in an unheated press at room temperature, followed by the second step that adds subsequent gentle heating at low temperature, is said to produce a laminated material at a low temperature compared to other processes.

Unfortunately, this process creates a laminated material having high compressibility, as the examples in the publication reveal; the laminated material has a compressibility in the range of 15 to 23 percent. This material is too highly compressible and not rigid enough to be suitable as electrical insulation such as spacers and/or sticks, or other structural components that require minimum compressibility and compression set.

So, what is needed is an improved method of making a dense sheet structure, such as thick papers and pressboard, having improved ply adhesion and adequate compressive properties.

BRIEF SUMMARY OF THE INVENTION

In one embodiment, this invention relates to a pressboard comprising a plurality of plies having thermostable floc and at least 40 weight percent aramid fibrids, the pressboard having a final average thickness of 0.9 mm or greater, the pressboard further having an a void content of 25 volume percent or less and a ply adhesion (Y) in megapascals defined by the equation $$Y>2.97(X)^{(-0.25)}$$

wherein (X) is the thickness of the pressboard in millimeters; the pressboard can have a compressibility of 1.6 percent or less and a compression set of 0.18 percent or less.

DETAILED DESCRIPTION OF THE INVENTION

This invention relates to an improved dense sheet structure, such as a pressboard, having improved ply adhesion and thereby improved localized delamination performance while also having improved compression properties, particularly improved compression set. By ply adhesion it is meant the peak load in delamination of the structure in z-direction (out of plane) of the sheet as measured in accordance with ASTM D 952-02.

This improved multi-ply sheet structure is made using methods that include the steps of combining a plurality of plies comprising aramid fibrids and thermostable floc, the plies having a moisture content of 1.5 to 7 weight percent; thermal laminating the plurality of plies at high temperature while maintaining the sheet under pressure for a time sufficient to form a sheet structure, followed by cooling the structure to a temperature below 100 C while maintaining pressure on the sheet structure. In some embodiments, at the end of the compression cycle, the resulting sheet structure has at least 1 percent of moisture in the sheet structure. The resulting sheet structure made with 40 or more weight percent fibrids and densified to achieve a void content of 25 or less volume percent has a ply adhesion (Y) in megapascals defined by the equation $$Y>2.97(X)^{(-0.25)}$$

wherein (X) is the thickness of the pressboard in millimeters; the pressboard can have a compressibility of 1.6 percent or less and a compression set of 0.18 percent or less.

The pressboard made by this process has surprising and very desirable compression properties. A pressboard having low compressibility and low compression set means the thickness dimension of the pressboard is more stable and more efficient in its function as a spacer in the design of an electrical device. In some embodiments, the compression set, which is the irreversible compression deformation of the pressboard during possible stresses at power outage and some other events, is 0.18 percent or less. In some embodiments the compressibility of this pressboard is also low, being 1.6 percent or less.

The plies used in the sheet structure can be formed by dry-laid or wet-laid methods. In some preferred embodiments, the wet-laid method is used to form an aramid sheet on equipment of any scale from laboratory screens to commercial-sized papermaking machinery, such as Fourdrinier, cylinder machines, or inclined wire machines. The general process involves making a dispersion of aramid fibrids, thermally stable fiber and other possible ingredients in an aqueous liquid, draining the liquid from the dispersion to yield a wet composition and drying the wet paper composition. The dispersion can be made either by dispersing the fibers and then adding the fibrids material or by dispersing the fibrids and then adding the fibers. The dispersion can also be made by combining a dispersion of fibers with a dispersion of the fibrids. The concentration of fibers in the dispersion can range from 0.01 to 1.0 weight percent based on the total weight of the dispersion. The concentration of the fibrids in the dispersion can be up to 90 weight percent based on the total weight of solids. Additional ingredients such as fillers for the adjustment of sheet conductivity and other properties, pigments, antioxidants, etc., in powder or fibrous form can be added to the composition.

The aqueous liquid of the dispersion is generally water, but may include various other materials such as pH-adjusting materials, forming aids, surfactants, defoamers and the like. The aqueous liquid is usually drained from the dispersion by conducting the dispersion onto a screen or other perforated support, retaining the dispersed solids and passing the liquid to yield a wet paper composition. The wet paper composition, once formed on the support, is usually further dewatered by vacuum or other pressure forces and further dried by evaporating the remaining liquid to form a ply used in the sheet structure.

The plies contain at least 10 weight percent aramid fibrids, with the remainder generally being thermostable floc. The term "fibrids" as used herein, means a very finely-divided polymer product of small, filmy, essentially two-dimensional particles having a length and width on the order of 100 to 1000 micrometers and a thickness only on the order of 0.1 to 1 micrometer. Fibrids are made by streaming a polymer solution into a coagulating bath of liquid that is immiscible with the solvent of the solution. The stream of polymer solution is subjected to strenuous shearing forces and turbulence as the polymer is coagulated. In some embodiments, the plies contain at least 40 weight percent aramid fibrids. These higher fibrid-content plies are most useful when very rigid sheet structures are desired, such as in pressboard.

Suitable aramid polymers useful in the aramid fibrids are polyamides wherein at least 85% of the amide (—CO—NH—) linkages are attached directly to two aromatic rings. Additives can be used with the aramid and it has been found that up to as much as 10 percent, by weight, of other polymeric material can be blended with the aramid. Copolymers can be used having as much as 10 percent of other diamines substituted for the diamine of the aramid or as much as 10 percent of other diacid chlorides substituted for the diacid chloride of the aramid. In some preferred embodiments the aramid fibrids comprise meta-aramid polymer, and in some most preferred embodiments the meta-aramid polymer is poly (metaphenylene isophthalamide).

As much as up to and including 90 weight percent of the composition of the individual plies includes a thermostable floc or a mixture of thermostable flocs. By "floc" is meant a fiber having a length of 2 to 25 millimeters, preferably 3 to 7 millimeters and a diameter of 3 to 20 micrometers, preferably 5 to 14 micrometers. If the floc length is less than 3 millimeters, its impact on the final laminate structure strength will not be high enough and if it is more than 25 millimeters, it is difficult to form a uniform web by a wet-laid method. If the floc diameter is less than 5 micrometers, it can be difficult to produce it with enough uniformity and reproducibility and if it is more than 20 micrometers, it is very difficult to form uniform paper of light to medium basis weights. Floc is generally made by cutting continuous spun filaments into specific-length pieces. In some embodiments, the plies contain as much as up to and including 60 weight percent thermostable floc or a mixture of thermostable flocs, with the remainder being aramid fibrids. This embodiment is especially useful when very rigid sheet structures are desired, such as in pressboard. Generally, the plies consist essentially of thermostable floc and aramid fibrids, but other paper additives may be added up to about 10 percent by weight. In some preferred embodiments, other materials such as thermoplastic floc are not present; however, in some embodiments up to 20 percent of other flocs may be present as long as the temperature stability of the final laminated sheet structure or pressboard is not compromised.

By "thermostable" is meant the fiber loses no more than 10 percent of its tenacity after exposure to 250 C. for 10 minutes in air. To determine if a fiber is thermostable, the tenacity of a sample of the fiber is measured at room temperature conditions; a sample is then heated in air to 250 C. for 10 minutes while restrained, and allowed to cool to room temperature conditions, and the tenacity is then measured and compared to measured tenacity of the unheated fiber. In some embodiments, the thermostable floc is selected from the group consisting of aramid fibers, glass fibers, carbon fibers, fluoropolymer fibers, polyimide fibers, liquid crystalline polyester fibers, polyethylene terephthalate fibers, polyacrylonitrile fibers, and mixtures thereof. However, floc from other materials can be used, for example, poly (ethylene terephthalate), polyacrylonitrile, etc. In some embodiments, the preferred thermostable floc includes aramid fibers, glass fibers, or mixtures thereof. In one preferred embodiment, the thermostable floc is meta-aramid floc and in a most preferred embodiment the floc comprises poly (metaphenylene isophthalamide).

An individual ply, prior to lamination, has a void content of at least 25 volume percent. It is believed this void content allows the fibrids in one ply to partially penetrate into another ply when the multi-ply stack of plies are subsequently compressed in the hot lamination process at a temperature near or above the glass transition temperature (Tg) of the fibrid polymer. In some embodiments the void content in an individual ply is 35 volume percent or more. In some embodiments the void content can be as high as 95 volume percent. In one embodiment, all of the individual plies have a void volume of at least 25 volume percent.

The multi-ply stack of plies, as it enters the thermal lamination step, has a moisture content of from 1.5 and 7 weight percent. It is believed at least one weight percent moisture should be maintained in the stack of plies during thermal lamination to obtain the desired better ply adhesion in the final laminate structure. If moisture content of the stack of plies prior to thermal lamination is less than 1.5 weight percent, it is difficult to maintain at least 1 weight percent in the laminate through all the entire lamination cycle and, correspondingly, to get the improvement in ply adhesion and surprising compression properties. It is believed no additional benefits are obtained if the moisture content of the plies going into thermal lamination is higher than 7 weight percent, only that more energy is required for heating and cooling steps, which is undesired.

The plies can be combined by layering one ply on the other, and in some embodiments typically between 2 and 12 plies can be layered together. This can be accomplished in a batch process by manually stacking discrete plies (sheets) together for placement in a heated platen press for batch compression; or in a continuous process the plies can be automatically and continuous combined together while unwinding them at the entrance into the nip of a double belt press or other equipment for the continuous thermal lamination.

The plies are provided to a heated press operating at a surface contact temperature of 250 to 400 C. In some embodiments the temperature is from 290 to 360 C. During this heating the stack of plies is thermally laminated at a pressure of at least 1.3 MPa that is maintained throughout the heating of the sheet structure. In some embodiments, the pressure is maintained at 3.5 to 5 MPa. In some embodiments wherein a continuous online process is used, such as a belt press, the thermal lamination is performed for about 30 seconds to 3 minutes. In some embodiments wherein a platen press is used, the thermal lamination is performed over several minutes, as much as 10 minutes, or even more for very thick structures. After thermal lamination, the laminating pressure of at least 1.3 MPa is maintained while the laminate structure is cooled below 100 C. In some embodiments a pressure of 3.5 to 5 MPa is maintained while cooling. Maintenance of high pressure throughout the heating and cooling ensures that the moisture retained in the laminate structure will not flash off once the pressure on the laminate is relieved. Generally the cooling time is dependent on the basis weight of the laminate sheet structure. If the laminate sheet structure is made in a manual batch process using a type of platen press, the cooling time can be significantly longer than the thermal lamination time, depending not only on the weight of the laminate sheet structure, but also upon the capabilities of the press. In some embodiments using a batch method, the cooling time can be as little as 30 minutes to as much as 2 hours.

In some embodiments, the thermal laminating and cooling are performed on a belt press having zones for heating and zones for cooling while maintaining the sheet structure under a substantially constant pressure. In some preferred embodiments the cooling is performed continuously on a belt press having at least one heated section and at least one cooled section. In this case, the time required for cooling can be the same as the time for thermal lamination, or can be shorter or longer. In some embodiments it is advantageous for the time required in the cooling step to be shorter than the thermal lamination time; in some embodiments this can be less than 3 minutes.

The sheet structure thermal lamination can be accomplished using a platen press, double belt press, or any other device that allows the application to the sheet structure of both heating and cooling while maintaining continuous pressure on the structure without any intermediate step of the pressure release. Useful processes can utilize belt presses of a type generally disclosed or derived from the arrangements shown in U.S. Pat. Nos. 4,336,096; 4,334,468; 5,098,514; 5,141,583; and 5,149,394.

In some preferred embodiments when a belt press is used, the same surface of the belt press provides both the heating and the cooling of the sheet structure; in other words, once the stack of plies enters the belt press, the same surface of the belt press provides both continuous pressure to the stack of plies and heating to make the heated laminate structure, and then continues to provide continuous pressure to that same laminate structure as it is cooled to below 100 C. In so doing, this allows the moisture in the plies to assist in the formation of a laminate structure having improved local delamination performance and surprising compression properties.

In some embodiments, the moisture content of the cooled laminate structure exiting the process is at least 1 weight percent, and the void content in the final laminate structure is 25 volume percent or less. The relatively small void content in the final laminate structure is important for a high level of ply adhesion and low compressibility and compression set. In the case of the pressboard type of the laminate structure, the preferred void content is 10 to 20 volume percent. Less than 10 volume percent of voids usually results in brittleness of the material and an elongation at break of less than 10 percent.

The plurality of plies is selected such that the sheet structure after cooling is a pressboard having a thickness of 0.90 mm or greater. In one very useful embodiment, the thickness of the pressboard is 0.90 and 10.0 mm.

The pressboard comprises a plurality of plies comprising thermostable floc and at least 40 weight percent aramid fibrids and having a thickness of 0.9 mm or greater, the pressboard having an a void content of 25 volume percent or less and a ply adhesion (Y) in megapascals defined by the equation $$Y>2.97(X)^{(-0.25)}$$

wherein (X) is the thickness of the pressboard in millimeters; the pressboard can have a compressibility of 1.6 percent or less and a compression set of 0.18 percent or less.

In some embodiments the final pressboard has a void content of from 10 to 20 volume percent. As stated before, if the void content is less than 10 volume percent the material will be brittle and even if the pressboard has a good level of ply adhesion, the processibility of the pressboard into final parts can be poor due to its excessive brittleness. Also, it is thought a void content of less than 10 volume percent makes it difficult to impregnate the pressboard with oil if the pressboard is used as electrical insulation in liquid-filled transformers. This lack of impregnation of the oil into the voids of the pressboard can cause partial localized electrical discharges in the insulation that over time cause the pressboard to fail in use.

For acceptable performance during processing and the final use, ply adhesion or tensile strength in the z-direction of the final laminate structure is very important. Inadequate ply adhesion can result in delamination and further failure of the material and the final electrical device.

The degree of flatness of the laminate structure is usually measured by the opposite characteristic, which is the degree of warpage. A laminate structure with less warpage is more flat. In preferred embodiments, the laminate structure or pressboard made in the manner previously described is flatter and has less warpage than laminate structures prepared with known methods of producing high compression resistance pressboard. One method of determining the relative amount of warpage of a laminate sheet structure, generally used as a quality control, is to take a rectangular sample of the laminate sheet structure as it is removed from the press, the sample having a width as wide as the press and a length that is perhaps 30 to 50 percent of the width. However, if desired, a square sample 50 by 50 cm can also be used. The laminate sheet structure is placed on a uniformly flat surface, such as a sturdy metal table, that has a top surface larger than the sample. One corner of the sheet is then pressed firmly by hand onto the flat metal table. If a section of the laminate structure has any warpage, that section will be forced upward and the distance the laminate sheet is raised from the table can be measured. In some embodiments using this measuring technique, the pressboard has a warpage as measured on a 50 by 50 cm sample of 2 mm or less.

Adequate tensile strength of the laminate structure or pressboard helps to ensure successful processibility of the material and its durability in the final application. In some embodiments, the pressboard has a tensile strength more than 80 MPa.

The measure of elongation at break of the laminate structure or pressboard characterizes its toughness or degree of brittleness. In some embodiments the pressboard has elongation at break of at least 10 percent when thermostable floc has initial modulus below 3000 cN/tex.

The compression properties of pressboard include compressibility, which characterizes total compression deformation at standard conditions, and compression set, which characterizes irreversible compression deformation. A pressboard that has both low compressibility and low compression set has a more stable thickness and is more efficient in its function as an insulative spacer in the design of electrical devices and machines. In some embodiments, the pressboard has a compressibility of 1.6 percent or less and in some embodiments the pressboard has a compression set of 0.18 percent or less. In a preferred embodiment, compression set is less than 0.15 percent.

The pressboard is useful as a part of electrical insulation systems for different electrical devices including motors, generators, and transformers, and, also, for different structural composites including cores and face sheets for sandwich panels. In these applications, the pressboard can be used either with or without impregnating resins, as desired.

TEST METHODS

Ply Adhesion or Tensile Strength in Z-direction of sheet structures was determined on an Instron®-type testing machine based on ASTM D 952-02 using circle shape samples with diameter 7.06 cm.

Thickness of sheets and sheet structures was determined in accordance with ASTM D 374-99.

Density, compressibility, and compression set of sheets and sheet structures were determined in accordance with ASTM D 3394-94. Compressibility and compression set were determined using rectangular samples having an in-plane dimension of 50.8 mm by 39.1 mm and with a total stack height of about 51 mm.

Tensile Properties of sheets and sheet structures were determined in accordance with ASTM D 202.

EXAMPLE 1

A medium density aramid pressboard (void content about 40 volume percent) to be used as plies in a thicker laminate structure, was made as described in U.S. Pat No. 4,752,355.The solid materials used in the making of this pressboard were 60 weight percent meta-aramid fibrids and 40 weight percent meta-aramid floc. The meta-aramid fibrids were made from poly (metaphenylene isophthalamide) as described in U.S. Pat No. 3,756,908. The meta-aramid floc was poly (metaphenylene isophthalamide) floc of linear density 0.22 tex (2.0 denier) and length of 0.64 cm with an initial modulus of about 800 cN/tex (sold by DuPont under the trade name NOMEX®). This medium density pressboard had a basis weight of 1214 g/m$^2$, a thickness of 1.5 mm, and a density of 0.81 g/cm$^3$.

Two sheets of this pressboard with in plane dimensions of 50×50 cm were equilibrated in air to a moisture content of 4.5 weight percent and loaded one on the top of another in the platen press heated to 285 C The two-ply structure was compressed for 2 minutes at temperature of 285 C and a pressure of 350 psi. After that, the press was cooled down, while maintaining the same pressure, to temperature of 90 C and held at this temperature for 10 minutes.

The final board had a moisture content of about 3 weight percent, a thickness of 2.0 mm and a density of 1.14 g/cm$^3$, which corresponded to a void content of about 16 volume percent. Ply adhesion was 3.2 MPa, compressibility was 1.14 percent and compression set was 0.12 percent. A sample of the final board was taken directly from the platen press for a warpage measurement; no appreciable warpage in this final board was found. Other properties of the pressboard are described in the Table 1 below.

COMPARATIVE EXAMPLE A

The medium density aramid pressboard of example 1, to be used as plies in a thicker laminate structure, was dried in the oven at 160 C for about 2 hours to essentially remove all moisture from the pressboard. As in Example 1, two sheets of this pressboard were loaded one on the top of another in a platen press heated to 285 C The two-ply structure was compressed for 2 minutes at temperature of 285 C and a pressure of 350 psi. After opening of the hot press, the hot compressed board was removed from the hot press and transferred to a cold press where it was cooled down to about 90 C.

The final board, as removed from the press, did not contain any measurable moisture, had a thickness of 2.0 mm and a density of 1.13 g/cm$^3$, which corresponded to void content of about 16 volume percent. Ply adhesion was 2.3 MPa, compressibility was 1.40 percent and compression set was 0.20 percent. The measured warpage of the final board was 3 mm. Other properties of the pressboard are described in the Table 1 below.

EXAMPLE 2

A low density aramid paper having a density of 0.27 g/cm$^3$ and a void content of about 80 volume percent) using the general method described in U.S. Pat No. 3,756,908 The solid materials used in the making of this pressboard were 60 weight percent meta-aramid fibrids and 40 weight percent meta-aramid floc and were the same as in Example 1.The paper had basis weight of 128 g/m$^2$.

Nine rolls of this paper with moisture content of 3.5 to 4 weight percent were installed on unwind stands of an isobaric double belt press having a heating zone of 2.1 meters in length and a cooling zone of 0.95 meters in length and 9 plies of the paper were laminated together by passing the stack of plies into heated and cooled zones of the press at a speed of 2 m/min and a pressure of 42 bars. The temperature of the heated zone was 312 C and the temperature at the end of the cooled zone was 95 C.

The final laminate structure had a moisture content of 3.2 weight percent, a thickness of 0.99 mm and a density of 1.14 g/cm$^3$, which corresponded to a void content of about 16 volume percent. Ply adhesion was 4.3 MPa, compressibility was 1.20% and compression set was 0.12%. Other properties of the pressboard are described in the Table 1 below.

EXAMPLE 3

A low density aramid paper was made similar to Example 2; however this paper had a void content of about 78 volume percent, was made from 54 weight percent meta-aramid fibrids and 46 weight percent meta-aramid floc, and had a basis weight of 196 g/m$^2$. Four rolls of this paper having a moisture content of 3.5 to 4 weight percent were laminated and subsequently cooled on the same isobaric double belt press as in Example 2 at a speed of 6 m/min and a pressure of 30 bars. The temperature of the heating zone was 312 C and temperature at the end of the cooling zone was 60 C. The final paper had moisture content of 2.8 weight percent, a thickness 0.73 mm and a density of 1.07 g/cm$^3$, which corresponded to a void content of about 22 volume percent. Ply adhesion was 4.0 MPa; other properties of the paper are described in the Table 1.

TABLE 1

| Example | T | D | V | C | CS | PA | S MD/CD | E MD/CD |
|---|---|---|---|---|---|---|---|---|
| 1 | 2.0 | 1.14 | 16 | 1.14 | 0.12 | 3.2 | 170/140 | 17/18 |
| A | 2.0 | 1.13 | 16 | 1.40 | 0.20 | 2.3 | 165/130 | 15/14 |
| 2 | 0.99 | 1.14 | 16 | 1.20 | 0.12 | 4.3 | 130/97 | 13/12 |
| 3 | 0.73 | 1.07 | 22 | | | 4.0 | 125/85 | 18/12 |

T = Thickness, mm
D = Density, g/mm3
V = Void Content, Volume %
C = Compressibility, %
CS = Compression Set, %
PA = Ply Adhesion, MPa
S MD/CD = Tensile Strength Machine Direction/Cross Direction, MPa
E MD/CD = Elongation at Break Machine Direction/Cross Direction, %

What is claimed is:

1. A pressboard consisting of a plurality of plies having thermostable floc and at least 40 weight percent aramid fibrids, where the thermostable floc are fibers having a length of 2 to 25 millimeters and a diameter of 3 to 20 micrometers and losing not more than 10 percent of its tenacity after exposure to 250° C. for 10 minutes in air and where the fibrids are polymer products of particles having a length and width in order of 100 to 1000 micrometers and thickness in the order of 0.1 to 1 micrometer, the pressboard having a final average thickness of 0.9 mm or greater, the pressboard having an a void content of 25 volume percent or less, characterized in that the pressboard has a ply adhesion (Y) in megapascals defined by the equation $$Y>2.97(X)^{(-0.25)}$$

wherein (X) is the thickness of the pressboard in millimeters, and wherein the ply adhesion is the peak load delamination of the structure in z-direction (out of plane) of the pressboard as measured in accordance with ASTM D 952-02, wherein the pressboard has compressibility of 1.6 percent or less and compression set of 0.18 percent or less.

2. The pressboard of claim 1 having tensile strength more than 80 MPa and elongation at break more than 10 percent.

3. The pressboard of claim 1 wherein the aramid fibrids are poly (metaphenylene isophthalamide) fibrids.

4. The pressboard of claim 1 wherein the thermostable floc has an initial modulus of lower than 3000 cN/tex.

5. The pressboard of claim 1 wherein the thermostable floc is selected from the group consisting of aramid fibers, glass fibers, carbon fibers, fluoropolymer fibers, polyimide fibers, liquid crystalline polyester fibers, polyethylene terephthalate fibers, polyacrylonitrile fibers, and mixtures thereof.

6. The pressboard of claim 5 wherein the aramid fibers are poly (metaphenylene isophthalamide) fibers.

* * * * *